United States Patent [19]

Redman

[11] 3,985,162

[45] Oct. 12, 1976

[54] KNOTTING GEAR

[75] Inventor: Howard E. Redman, Duxbury, Mass.

[73] Assignee: Mathewson Corporation, Quincy, Mass.

[22] Filed: May 9, 1975

[21] Appl. No.: 576,129

[52] U.S. Cl. ..... 140/36; 140/101; 140/115

[51] Int. Cl.[2] ..... B21F 15/04

[58] Field of Search ..... 140/36, 101, 115, 116

[56] References Cited

UNITED STATES PATENTS 413,666 10/1889 Hill ..... 140/36

3,338,273 8/1967 Kalning ..... 140/101

*Primary Examiner*—Lowell A. Larson

*Attorney, Agent, or Firm*—Robert T. Gammons

[57] ABSTRACT

A rotary knotting head for a wire tying machine containing an axial bore and radial slot to the bore for receiving the wire and a wire wrap surface spaced from the bore at the opposite side of the radial slot characterized in that wear resistant inserts are set into faces of the wrap surface and the side of the slot opposite the wrap surface which extend from the bottom of the radial slot radially towards the open end thereof and are of substantially the same area.

1 Claim, 9 Drawing Figures

KNOTTING GEAR

BACKGROUND OF INVENTION

The provision of a wear resistant insert in the face of the wrap surface of a knotting head is disclosed in U.S. Pat. No. 3,338,273 assigned to United Mattress Machinery Company, assignee of this application. The insert as disclosed in that patent is adjustably mounted in the segmental extension to provide for wires of different gauge. In operation the hardened insert applies the wrapping pressure as the free end of the wire is wrapped around the wire of the end loop. The wrapping pressure thus applied presses the portion of the end loop about which the end is being wrapped against the side of the radial slot opposite the wrap surface which results in rapid destructive wear so that frequent replacement of the entire knotting head is required. In order to rectify the aforesaid problem the hardened insert as disclosed in the aforesaid patent was replaced by a circular plug set into the end face of the extension and the end face of the body around the closed end of the radial slot containing a radial slot coinciding with the radial slot in the body. The plug was comprised of carbide steel and while extremely hard and resistant to wear it was relatively brittle so that the pressure developed cracked the plug at the closed end of the radial slot. The purpose of this invention is to provide means in both the wrap surface and the opposed surface of the radial slot which are wear resistant and will withstand the wrapping and wedging pressures developed during the knotting operation.

SUMMARY OF INVENTION

As herein illustrated the invention resides in a rotary knotting head for use in wire tying machines, comprising a cylindrical body having external bearing surfaces, an axially disposed wire receiving bore, a radially extending slot to the bore and an end face having thereon a segmental extension providing along one side a transverse wire wrap surface extending across said end face spaced from said bore at one side of the slot and hard wear resistant parts set into the face of the wrap surface and the face of the slot opposite the wrap surface, said parts providing bearing surfaces flush with said faces which extend from the closed end of the slot radially therefrom toward the open end of the slot. The bearing surfaces are located at substantially the same radial distances from the bottom of the slot and diverge from the bottom toward the open end, the surfaces being situated at the trailing side in the wrap surface and slot with respect to the direction of rotation of the knotting head. The parts are fixed in recesses in the end faces of the extension and the body which open into the face of the wrap surface and the face of the slot, the recesses being axially offset such that the bottom of the recess in the extension is in the plane containing the top of the recess in the body. The wear resistant parts are comprised of carbide steel and may be cemented or brazed into the recesses.

The invention will now be described in greater detail with reference to the accompanying drawings, wherein.

Figure 5:
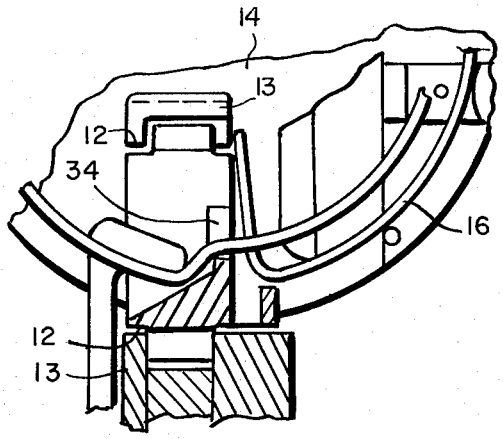
FIG. 5 is a fragmentary view partly in section illustrating the knotting head and associated portions of the knotting machine including the knotting head bearing support and end plate and clamp by means of which the coil is held for the knotting of the wire end about a segment of the previous convolution of the coil.

In accordance with conventional construction as illustrated, for example, in U.S. Pat. No. 2,604,202, the knotting head 10 which is provided with external bearings 12—12 is rotatably supported in bearings 13—13 at the end of a pivotally mounted arm not shown herein for movement from a position below a coil supporting head 14 to which the coil spring 16 is clamped for movement upwardly to engage the knotting head with the coil for the knotting operation as shown in FIG. 5.

Figure 1:
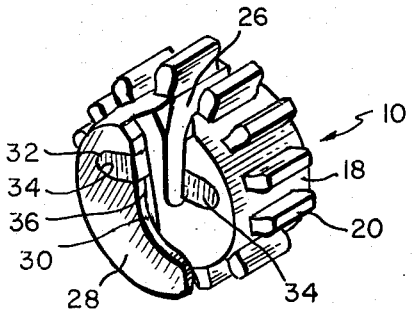
FIG. 1 is a perspective of the knotting head.
Figure 2:
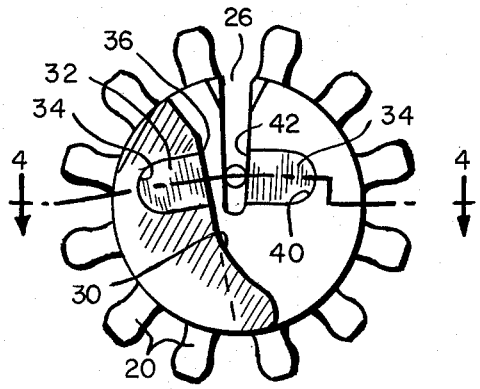
FIG. 2 is an elevation as seen from the front side of FIG. 1 showing the approximate position of the wire in the radial slot.
Figure 3:
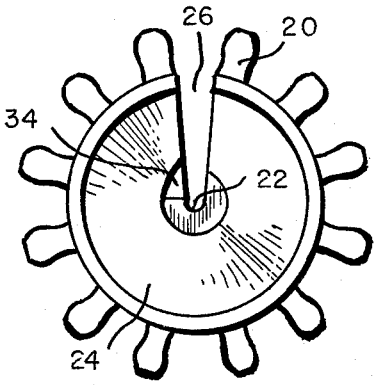
FIG. 3 is an elevation as seen from the rear side of FIG. 1.
Figure 4:
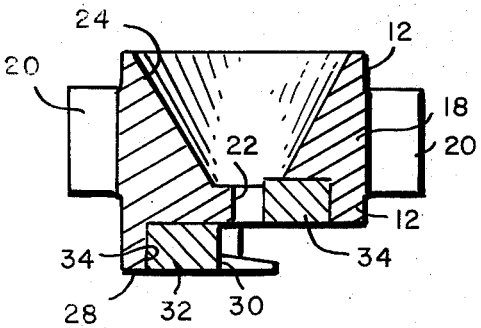
FIG. 4 is a section taken on the line 4—4 of FIG. 2.
Figure 9:
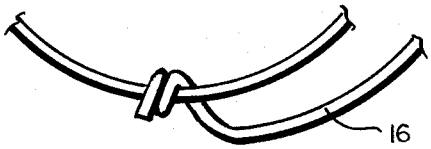
FIG. 9 is a fragmentary view showing the knotting of the wire end about a segment of the previous convolution of the coil.

The knotting head 10, FIGS. 1 and 4, has cylindrical body portion 18, periperally of which there are teeth 20 by means of which it is rotated and at the opposite end faces of which are the bearings 12—12. The body portion 18 contains a centered bore 22 which extends axially through the body from one end face toward the other into a concentric conical opening 24 at the other face of the body. A wire receiving radially extending slot 26 extends from the surface of the body into the bore 22 and conical opening 24 for entrance of the segmental portion of the coil about which the wire end is to be wrapped through the bore for rotation of the knotting gear about the segment as the wire end is wrapped about it. Wrapping is effected by a segmental extension 28 at the end face of the body which has a wrap surface 30 along one side spaced from the bore 22. The knotting head as thus far described corresponds basically in construction to that shown in the aforesaid U.S. Pat. No. 3,338,273.

In accordance with this invention, to provide for wear on the face of the wrap surface and on the surface of the slot opposite the wrap surface two independently mounted wear resistant inserts 32 and 34 are employed. The insert 32 is mounted in an opening 34 formed in the end face of the extension 28 which opens at 36 through the wrap surface 30. The recess 34 bottoms in the plane of the end face of the body. The insert 34 is mounted in a recess 40 in the end face of the body which opens at 42 into the side of the slot 26 opposite the wrap surface 30 and bottoms substantially at the apex of the conical opening 44 as shown in FIG. 4. The exposed surfaces of the inserts 32 and 34 are ground so as to be flush with the wrap surface 30 and the surface of the slot 26, have substantially the same area and are axially offset so that the inner side of the insert 32 lies substantially in the plane of the outer side of the insert 34.

The hardened inserts 32,34 are comprised of, for example, carbide steel and may be secured in the recesses by cementing, brazing or the like. Preferably, they are cemented in place so that they can be removed after wear and replaced without having to supply a new knotting head.

Figure 6:
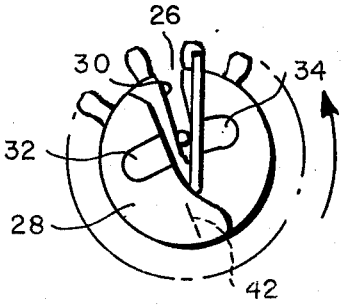
FIGS. 6, 7 and 8 are views at the front side of the knotting head which rotates in a counterclockwise direction showing the successive positions of the knotting head forming a first wrap of the wire end about the wire segment supported centrally of the knotting head.
Figure 7:
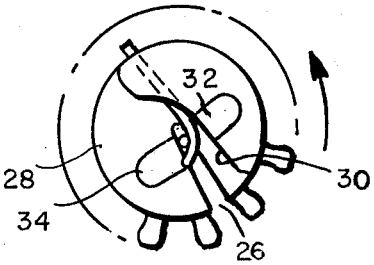
Figure 8:
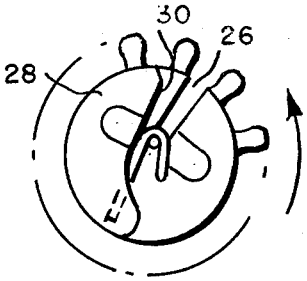

FIGS. 6, 7 and 8 show the successive positions of the knotting head as it commences to wrap the wire end of the coil about the segment of the end loop of the previous convolution of the coil, showing in FIG. 6 the segment of the wire at the center of the bore with the end of the wire extending upwardly therefrom at the right hand side of the segment. FIG. 7 shows the knotting head turned counterclockwise approximately 180° so as to bring the insert 32 into engagement with the wire end to commence the wrapping operation and FIG. 8 shows the knotting head rotated through substantially another 180° to form the first twist about the segment. It is to be noted that the bearing surface of the hardened plug 32 in the face of the wrap surface engages the wire end at the position shown in FIG. 7 and that the pressure developed at this point forces the wire segment against the hardened insert 34 in the face of the slot. The two wear resistant inserts 32,34 thus collectively take up the destructive wire produced by the winding operation without sacrificing hardness and wear resistance for strength since strength is no longer a critical factor in maintaining their integrity. The hardness of the inserts is in the order of Rockwell C70.

The knotting head as thus constructed requires only a minimum modification of the standard knotting head, permits easy replacement in the event of wear and resists successfully the destructive shock developed by the winding operation.

It should be understood that the present disclosure is for the purpose of illustration only and includes all modifications or improvements which fall within the scope of the appended claims.

I claim:

1. A rotary knotting head for use in a wire tying machine comprising, a cylindrical body having external axially aligned concentric bearing surfaces, an axially disposed wire receiving bore, a radially extending slot in communication with said bore and at one end an integral segmental extension providing at that end along one side of the end face a transverse wire wrap surface extending across said end face spaced from said bore at one side of the slot, said segmental extension containing a U-shaped recess which opens to the wrap surface and said cylindrical body containing a U-shaped recess open to the surface of the slot opposite the recess in the segmental extension, said recesses being axially offset such that the inner end of the recess in the segmental extension lies in the plane of the outer end of the recess in the cylindrical body and a hard wear resistant part fixed in each recess, said parts having flat bearing surfaces which coincide with the wrap surface and said surface of the slot and said recesses being tilted relative to each other such that their center lines intersect at a point above the bottom of the slot and said bearing surfaces diverge, said parts being totally confined within the recesses except for the flat bearing surfaces exposed at the open sides of the recesses so that the reactive pressures developed during winding are transferred from the bearing surfaces to the cylindrical body and segmental extension thereof.

* * * * *